US005779524A

United States Patent [19]

Swain

[11] Patent Number: 5,779,524

[45] Date of Patent: Jul. 14, 1998

[54] ADJUSTABLE CAGE ASSEMBLY FOR MOBILE SURFACE ABRADING APPARATUS

[76] Inventor: Jon M. Swain, 3145 Holloway Rd., Ruston, La. 71270

[21] Appl. No.: 734,539

[22] Filed: Oct. 21, 1996

[51] Int. Cl.[6] ..... B24C 7/00

[52] U.S. Cl. ..... 541/102; 451/38; 451/94; 451/95; 451/96; 451/97; 451/98

[58] Field of Search ..... 451/94, 95–98, 451/38, 2, 102

[56] References Cited

U.S. PATENT DOCUMENTS

| | | | |
|---|---|---|---|
| 2,352,588 | 6/1944 | Rosenberger et al. | 451/95 |
| 5,209,024 | 5/1993 | Carpenter et al. | 451/97 |

FOREIGN PATENT DOCUMENTS

| | | | |
|---|---|---|---|
| 212685 | 8/1984 | Germany | 451/94 |

*Primary Examiner*—Robert A. Rose
*Assistant Examiner*—George Nguyen
*Attorney, Agent, or Firm*—John M. Harrison

[57] ABSTRACT

An adjustable cage assembly for selectively varying the path of abrasive in an abrasive blast swath produced by a mobile surface abrading apparatus. The adjustable cage assembly operates in cooperation with a rotable wheel having multiple, radially-extending blades positioned in a wheel housing. A cage having a cage window extends into the center of the wheel and an impeller having multiple impeller slots is positioned in the cage for rotation with the wheel, and receives a supply of abrasive particles such as steel shot, from the apparatus. As the impeller and wheel are rotated and the abrasive is continually fed into the impeller, the abrasive is discharged through the rotatably aligned impeller slots and the selectively-positioned cage window, and is propelled by the rotating wheel blades through the abrasive discharge opening to abrade, clean or etch the pavement. By remote-control operation of an actuator mounted on the wheel housing, the cage and cage window can be selectively rotated to change the direction of abrasive impact on the pavement surface. In another embodiment a series of triangular-shaped deflectors are provided on the lateral walls of the wheel housing discharge and some of the abrasive in the blast swath strikes the deflectors and is deflected at varying angles to the surface being textured, such that the edges of the resulting textured pattern have a feathered appearance. when an adjacent pass is overlapped in the feathered section, a blending of the passes gives the appearance of one continual pass.

11 Claims, 5 Drawing Sheets

ADJUSTABLE CAGE ASSEMBLY FOR MOBILE SURFACE ABRADING APPARATUS

BACKGROUND OF THE INVENTION

1. Field of the Invention

This invention relates to devices for abrading or cleaning horizontal paved surfaces such as roads, airport runways and the like. More particularly, the invention relates an adjustable cage assembly for selectively varying or directing the impact area of abrasive striking a surface and deflectors for creating a uniformly textured surface appearance. In a preferred embodiment the adjustable cage assembly is disposed in a wheel housing mounted on a mobile surface abrading apparatus, which apparatus traverses the surface to be treated. One or more wheels, each having multiple wheel blades, is journalled for rotation in the wheel housing above an abrasive discharge opening. A cylindrical cage having a cage opening or window, extends axially into the wheel and is selectively and adjustably rotated by means of an actuator provided on the housing. An impeller having multiple impeller slots is mounted on the motor shaft inside the cage, for rotation with the wheel. As the wheel and impeller are rotated, a supply of abrasive particles such as steel shot, is continually discharged into the impeller and the abrasive is propelled through the rotating impeller slots and stationary cage window, respectively, onto the wheel, where it is further propelled by the wheel blades through the abrasive discharge opening in the wheel housing, to strike a selected location on the surface to be treated, thereby producing a surface texture. The abrasive is then typically deflected from the surface back into the mobile surface abrading apparatus, and is thus repeatedly projected onto the surface in an abrasion cycle. By operation of the actuator, the position of the cage and cage window in the rotating wheel can be selectively and incrementally adjusted by the operator without stopping the machine, to vary or adjust the location of abrasive impact on the surface and thereby achieve a uniform surface texture as the apparatus traverses the pavement. In another embodiment triangular-shaped deflectors having varying strike surface angles are shaped in or mounted on the lateral walls of the wheel housing below the abrasive discharge opening, such that a portion of the abrasive particles in the blast swath strike the deflectors and are deflected to the pavement surface at the varying deflection angles, producing a lightly-abraded or feathering effect in the edges of the textured pattern. When an adjacent abrasion traversal is subsequently made on the pavement overlapping the newly textured pattern, equal, rather than excessive, abrasion in the overlap areas of the patterns, presents a uniform, visually-pleasing textured surface which is substantially devoid of streaks, grooves and other excessive overlap marks.

2. Description of the Prior Art

A standard or conventional mobile surface abrading apparatus typically includes a mobile frame having wheels or endless tracks for traversing the surface to be treated. The frame includes a reservoir or hopper for containing abrasive particles and one or more abrasive propulsion devices or wheels for projecting the abrasive at the surface to be treated. Each abrasive propulsion device typically includes a wheel which is rotatably mounted in a wheel housing and has multiple, radially-extending blades. A cylindrical abrasive cage having a slot or window, extends axially through the wheel and an impeller having multiple impeller slots is provided in the cage for rotation with the wheel. As the impeller and wheel are rotated, the abrasive is dispensed from the reservoir into the impeller, projected through the rotating impeller slots and stationary cage window, respectively, and is propelled by the wheel through a discharge opening in the wheel housing. The abrasive then strikes the surface at an angle, producing a surface texture on the portion of the surface covered by the discharge opening, according to the position of the cage window in the rotating wheel. The abrasive is deflected from the surface and is typically recycled for repeated use.

Because the "hot spot", or area of heaviest abrasive concentration, is typically located in the center of the abrasive swath formed by the cage window of the stationary cage, the texturing pattern produced by the abrasive swath in the surface is deeper or more pronounced in the center of the abrasive pattern than in the surrounding areas of the pattern. Furthermore, because conventionally, the cage may only be rotated manually in the wheel housing when the apparatus is not in operation, varying or adjusting the location of the "hot spot" on the surface in order to achieve a more uniform surface texture pattern, is laborious and time-consuming.

The discharge opening of the wheel housing of conventional machines is typically rectangular in cross-section and includes four walls, the narrow walls being parallel to the direction of travel of the apparatus. These narrow, or lateral walls define the lateral boundaries of the abrasion swath and abrasive particles which strike the walls are deflected onto the pavement surface at an almost perpendicular angle, resulting in a well-defined abrasion pattern between the treated and untreated portions of the surface. As a result of this deflection, when an adjacent traversal is made on the surface being textured, the area of treatment overlapped by the two resulting patterns becomes grooved and is very noticeable, due to the doubling of the abrasion in the overlap area.

Various attempts have been made to achieve a more uniform spread of abrasive throughout the blast swath, including reconfiguration of the cage window. When any edge of the cage window is angled, however, abrasive is frequently discharged through the cage window at an undesirable angle, such that the abrasive does not enter the wheel blades as intended, resulting in a non-uniform spread of abrasive in the swath. Furthermore, because the position of the cage window may be adjusted only by manual rotation of the cage when the apparatus is not in operation, trial-and-error rotation of the cage after stopping the apparatus is essentially the only way to achieve a fine, trial and error adjustment of the "hot spot" on the pavement. This method of adjusting the abrasive swath by manual rotation of the cage and cage window is particularly time-consuming when a surface abrading apparatus having multiple abrasive propulsion devices is being used to texture or clean the surface by a single operator.

In my U.S. Pat. No. 4,433,511, dated Feb. 28, 1984, entitled "Mobile Abrasive Blasting Surface Treating Apparatus", I detail a mobile apparatus for treating structural surfaces by abrasive blasting. The apparatus includes a mobile housing adapted for traversing the surface to be treated and includes a reservoir for containing abrasive particles and a rotating wheel for propelling the abrasive particles against the surface to be treated to abrade or etch the surface.

Other abrading devices known in the art are those detailed in the following U.S. Pat. No. : U.S. Pat.No. 3,858,359, dated Jan. 7, 1975, to Raymond M. Leiliart, entitled "Mobile Surface Treating Apparatus"; U.S. Pat.No. 3,877,174, dated Apr. 15, 1975, to Clyde A. Snyder, entitled "Mobile Surface Treating Apparatus"; U.S. Pat.No. 3,934,373, dated Jan. 27, 1976, to Raymond M. Leiliart, entitled "Portable Surface Treating Apparatus"; U.S. Pat. No. 3,977,128, dated Aug. 31, 1976, to James R. Goff, entitled "Surface Treating Apparatus"; U.S. Pat. No. 4,080,760, dated Mar. 28, 1978, to Raymond Leiliart, entitled "Surface Treatment Device Including Magnetic Shot Separator"; U.S. Pat. No. 4,052,820, dated Oct. 11, 1977, to John C. Bergh, entitled "Portable Surface Treating Apparatus"; U.S. Pat. No. 4,336,671, dated Jun. 29, 1982, to Robert T. Nelson, entitled "Surface Cleaning Apparatus"; U.S. Pat. No. 4,364,823, dated Dec. 21, 1982, entitled "Apparatus For Separating Abrasive Blasting Media From Debris"; U.S. Pat. No. 4,376,358, dated Mar. 15, 1983, to John J. Shelton, entitled "Surface Treating Apparatus"; U.S. Pat. No. "4,377,922", dated Mar. 29, 1983, to John C. Bergh, entitled "Portable Apparatus For Treating Surfaces"; U.S. Pat. No. "4,377,923", dated Mar. 29, 1983, to John C. Bergh, entitled "Surface Treating Apparatus"; U.S. Pat. No. 4,377,924, dated Mar. 29, 1983, to John C. Bergh, entitled "Portable Device For Treating Surfaces"; U.S. Pat. No. 4,382,352, dated May 10, 1983, to Robert T. Nelson, entitled "Apparatus For Cleaning Surfaces Including Means For Separating Debris and Abrasive Material"; U.S. Pat. No. 4,394,256, dated Jul. 19, 1983, to James R. Goff, entitled "Apparatus For Separating Abrasive Blasting Media From Debris"; and U.S. Pat. No. 4,406,092, dated Sep. 27, 1983, entitled "Surface Cleaning Machine".

An object of this invention is to provide an adjustable cage assembly for mounting on a mobile surface abrading apparatus and adjusting and varying the impact area of abrasive in an abrasive blast swath produced on a surface traversed by the mobile surface abrading apparatus.

Another object of this invention is to provide an adjustable cage assembly for a mobile surface abrading apparatus, which cage assembly is mounted in a housing and operates in cooperation with a wheel rotatably mounted in the housing above the abrasive discharge opening. A cage having a cage window extends axially into the wheel and an impeller having multiple impeller slots is provided in the cage for rotation with the wheel. The impeller receives a continuous supply of abrasive particles, typically steel shot, which is discharged or falls through the rotating impeller slots and the cage window, respectively, and the wheel propels the abrasive particles through a discharge in the housing to strike the surface in angular relationship, and texture, clean or abrade the surface. The orientation of the cage and cage window in the wheel may be selectively varied while the machine is operating, to adjust or vary the discharge of the most concentrated flow of abrasive in the abrasive particle swath on the surface, by remote or direct control operation of an actuator, or other linkage device, which is mounted on the housing and attached to a circular plate rotatably mounted in the housing and attached to the cage.

Still another object of this invention is to provide an adjustable cage assembly for a mobile surface abrading apparatus, which assembly operates in cooperation with triangular-shaped deflectors shaped in or mounted on the lateral (frontal) walls of the housing and having varying impact surface angles, such that a portion of the abrasive strike the deflectors and are deflected to the surface at varying angles, resulting in a surface texture pattern having feathered or lightly-defined edges.

SUMMARY OF INVENTION

These and other objects of the invention are provided in adjustable cage assemblies for varying the discharge of the most concentrated flow of abrasive in a swath of abrasive particles propelled from a mobile surface abrading apparatus on a paved surface. In a preferred embodiment each of the adjustable cage assemblies is mounted in a wheel housing on the apparatus and in cooperation with a wheel which has multiple, circumferentially-spaced, radially-extending blades and is rotatably mounted in the housing and typically driven by a wheel motor mounted on the housing exterior. A cylindrical abrasive cage having a cage window opening extends axially into the wheel and an impeller having multiple impeller slots is mounted on the shaft of the hydraulic motor inside the abrasive cage. As the impeller and wheel are rotated by the motor with respect to the adjustable cage, a supply of abrasive particulate is selectively and continually discharged into the impeller and the particles fall through the impeller slots and cage window, respectively, and are propelled by the rotating wheel blades through a discharge opening in the bottom of the wheel housing, striking the paved surface at an angle and abrading a surface texture in the paved surface. The abrasive cage may be selectively rotated by remote-control operation of an actuator provided on the wheel housing to selectively vary the position of the cage window and facilitate coarse or fine adjustment of the concentrated flow of abrasive onto the surface, without having to halt operation of the apparatus and manually rotate the cage. In a preferred embodiment, the wheel housing includes a discharge area which is provided with a series of triangular-shaped deflectors having separately angled striking surfaces formed in or mounted on the lateral walls of the wheel housing, such that abrasive particles in the blast swath strike the deflectors and are deflected at varying rebound angles to the surface, producing a textured pattern having lightly-defined or feathered edges.

BRIEF DESCRIPTION OF THE DRAWINGS

The invention will be better understood by reference to the accompanying drawings, wherein.

DESCRIPTION OF THE PREFERRED EMBODIMENTS

Figure 1:
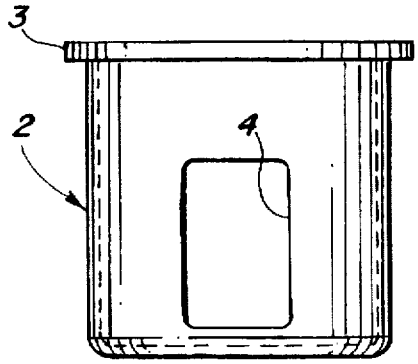
FIG. 1 is a side view of the rotatably adjustable cage and cage window element of the adjustable cage assembly of this invention.
Figure 2:
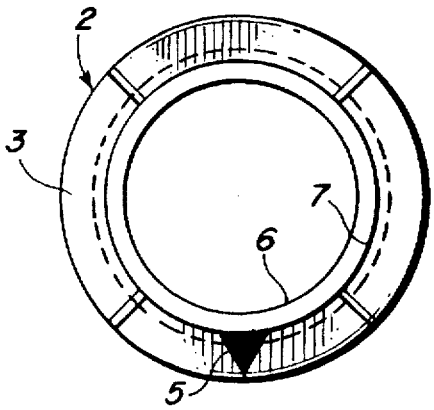
FIG. 2 is a top view of the cage illustrated in FIG. 1.
Figure 3:
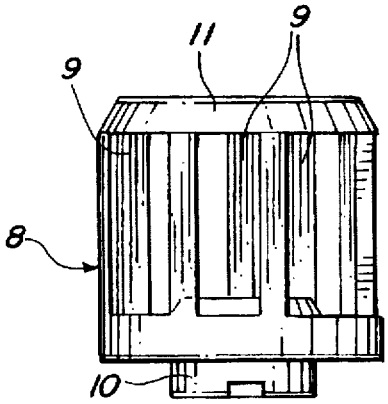
FIG. 3 is a side view of the rotating impeller element of the adjustable cage assembly.
Figure 4:
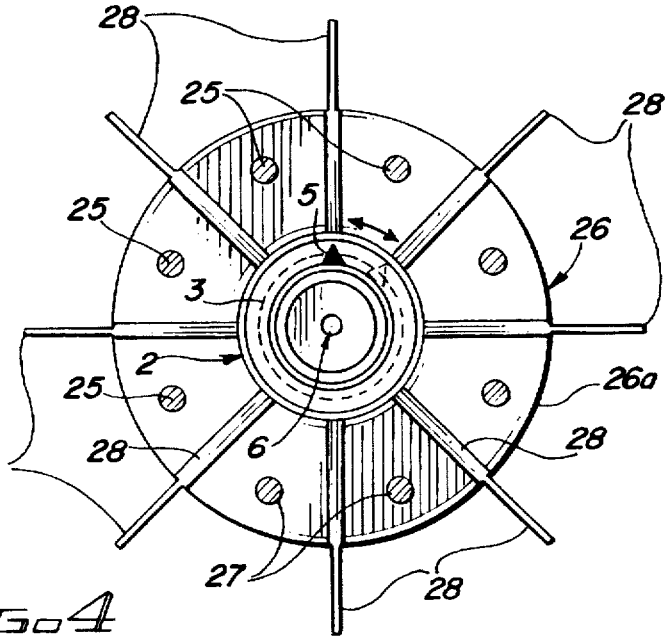
FIG. 4 is a side view of a typical rotary wheel which receives the impeller of the adjustable cage assembly.
Figures 9, 12:
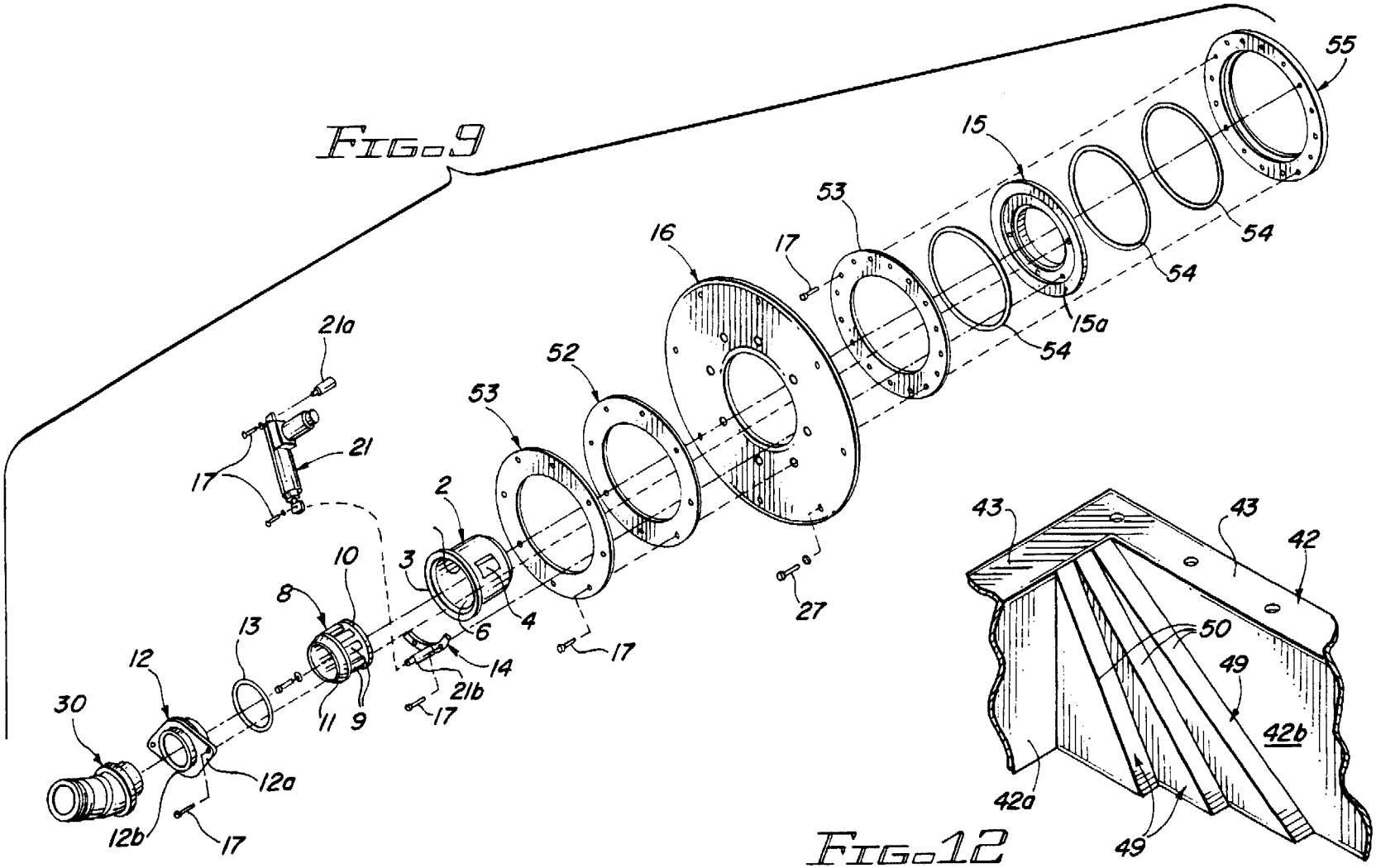
FIG. 9 is an exploded, perspective view of a preferred embodiment of the cage plate, abrasive cage, impeller and associated elements of the adjustable cage assembly of this invention.
FIG. 12 is an enlarged, perspective view, partially in section, of the housing discharge of the mobile surface abrading apparatus of this invention, more particularly illustrating the deflector elements.
Figure 10:
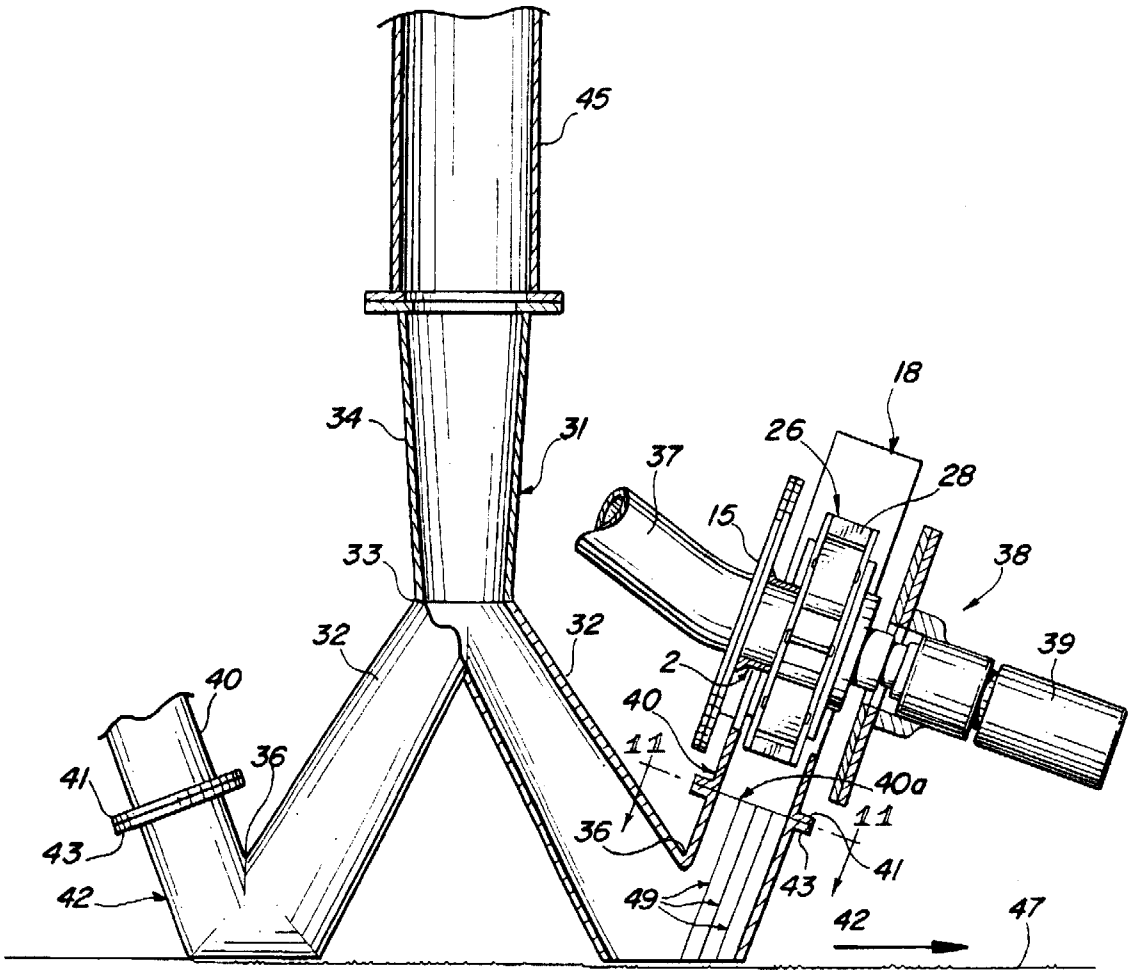
FIG. 10 is a side view, partially in section, of an abrasive propulsion device mounted on the wheel housing of a conventional mobile surface abrading apparatus, with three deflector elements provided in the abrasive discharge area of the housing.

Referring initially to FIGS. 1–3, 8 and 10 of the drawings, a mobile surface abrading apparatus (not illustrated) hereinafter referred to as the "apparatus", typically includes one or more blast heads 31 (one of which is illustrated in FIG. 10), each of which extends downwardly from a mobile, wheeled frame (not illustrated), adapted for traversing a horizontal paved surface 47, such as a road, highway or airport runway. Each blast head 31 terminates in close proximity to the surface 47 and typically includes a collection leg 34, which extends downwardly to define a pair of diverging rebound legs 32 at a rebound neck 33, as further illustrated in FIG. 10. A discharge plenum 42 typically angles upwardly from each rebound leg 32, defining a mirror angle 36, and a pair of abrasive propulsion devices 38, typically connected by a housing connector 19 (illustrated in FIG. 8), are adjacently mounted on each discharge plenum 42. As further illustrated in FIGS. 4, 8 and 10, each abrasion propulsion device 38 includes a wheel housing 18, enclosing a wheel 26, which is journalled for rotation in the wheel housing 18 and includes multiple, circumferentially-spaced, radially-extending wheel blades 28. A wheel motor 39, illustrated in FIG. 10, is mounted on the exterior of the wheel housing 18 and includes a motor shaft (not illustrated) which mounts the wheel 26 for rotation. A substantially cylindrical cage 2, illustrated in FIGS. 1 and 2, is shaped with a front cage opening 7, a rear cage opening 6, a generally rectangular cage window 4 and a cage rim 3, and the cage 2 extends axially through the center of the wheel 26. The cage 2 can be manually or remotely rotated with respect to the wheel housing 18 to vary the position of the cage window 4 in the wheel 26 and thus adjust the location of impact of the most concentrated flow of abrasive in the abrasive swath on the surface 47, as hereinafter further described. A cage indicator mark 5 is typically, but not necessarily, provided on the cage rim 3 for indicating the position of the cage window 4 in the rotary wheel 26, as illustrated in FIG. 2. A cylindrical impeller 8, illustrated in FIG. 3, having multiple, circumferentially-spaced impeller slots 9, is mounted on the shaft of the wheel motor 39 and extends inside the cage 2. A feed conduit 37, illustrated in FIG. 10, originates in the bottom of a reservoir or hopper (not illustrated) provided on the apparatus, which hopper contains a supply of abrasive particles (also not illustrated), such as steel shot and the feed conduit 37 extends through the wheel housing 18 and terminates at a feed spout 30, mounted in a cage clamp 12, extending to the bevelled end 11 of the impeller 8, as illustrated in FIG. 9. An abrasive discharge 40, having an abrasive discharge opening 40*a* and terminating in an abrasive discharge flange 41, further illustrated in FIG. 10, extends the bottom end of the wheel housing 18 and the abrasive discharge flange 41 is attached to a discharge extension flange 43, shaped on the upper end of a discharge plenum 42.

Figure 6:
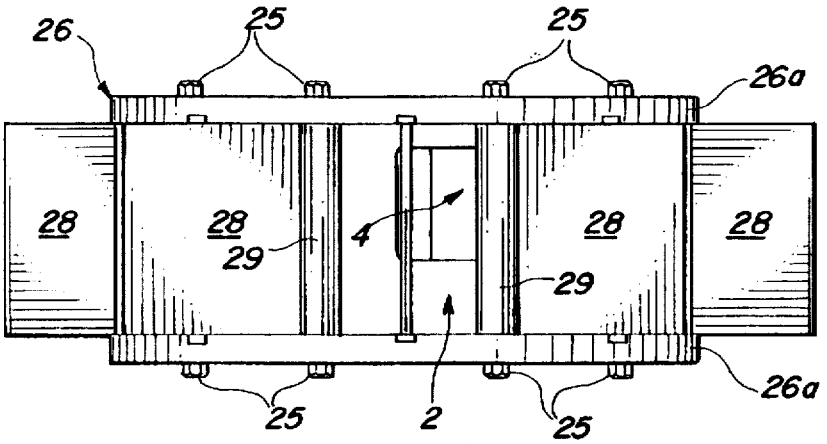
FIG. 6 is a bottom view of the assembled rotary wheel and cage, more particularly illustrating a selected, remotely-adjusted position of the cage and cage window.
Figure 7:
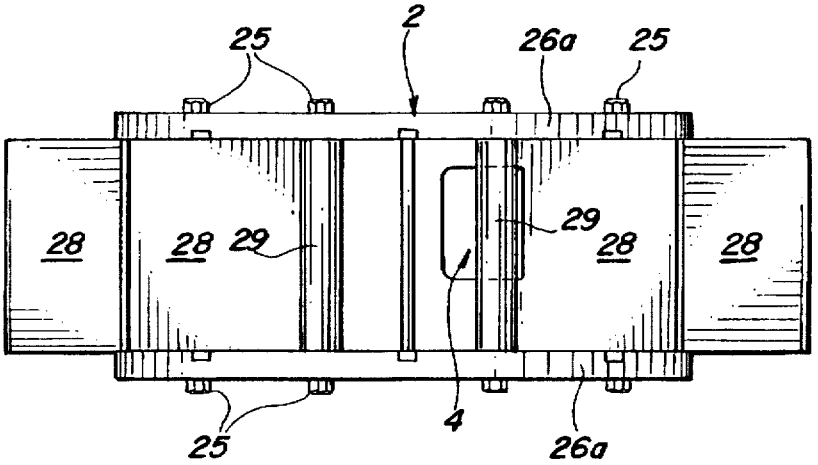
FIG. 7 is a bottom view of the assembled rotary wheel and abrasive cage, more particularly illustrating still another selected remotely-adjusted position of the cage and cage window.
Figure 8:
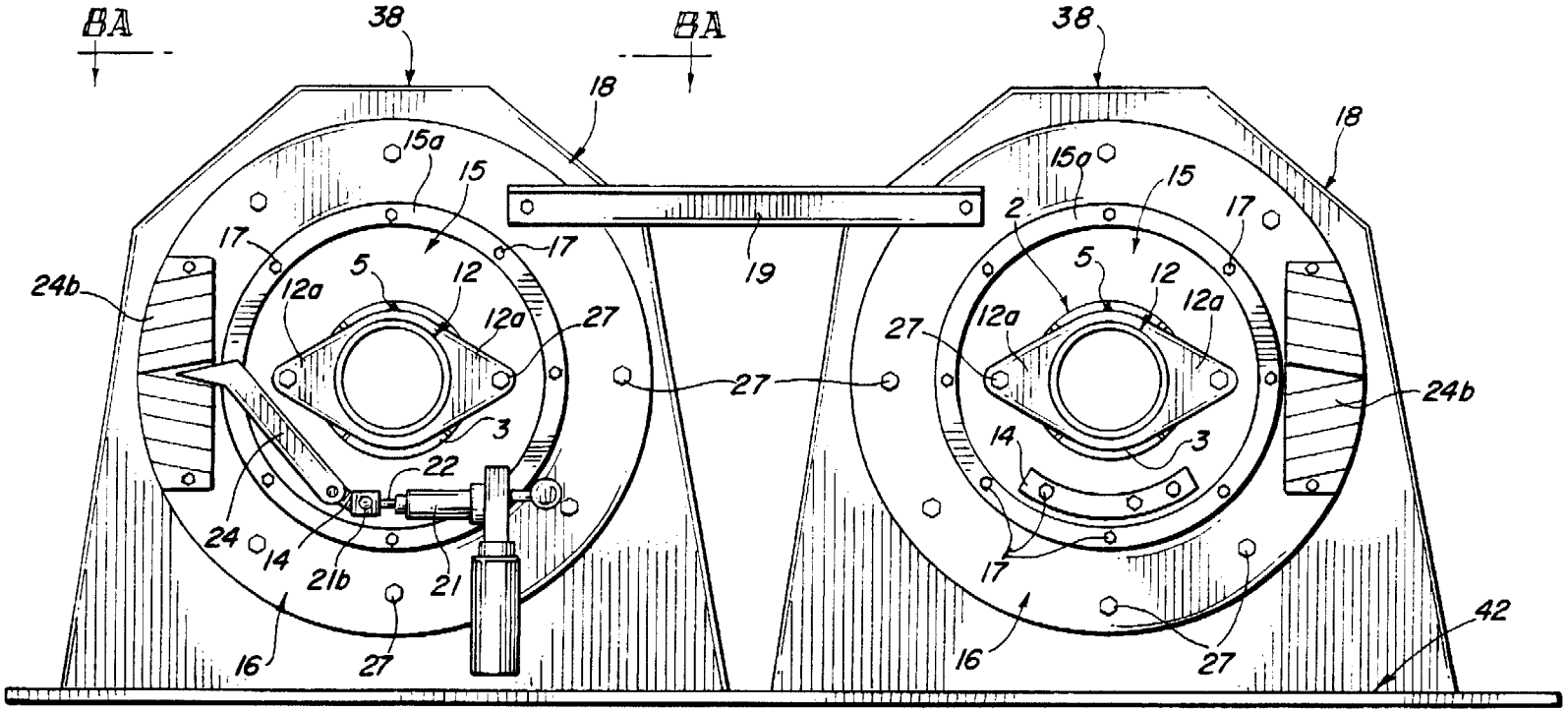
FIG. 8 is a rear view of a pair of abrasive propulsion devices adjacently mounted on the blast head of a mobile surface abrading apparatus.
Figure 8A:
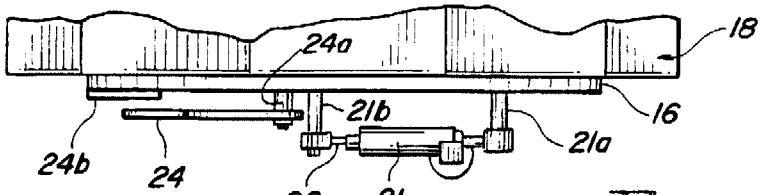
FIG. 8A is a top view, taken along line 8A–8A in FIG. 8, of the actuator element of the adjustable cage assembly.

Referring next to FIGS. 1–9 of the drawings, in a preferred embodiment the adjustable cage assembly of this invention is illustrated by reference numeral 1 in FIG. 9 and includes a mobil cage plate 15, having a cage plate flange 15*a*, rotatably mounted in a face plate 16 by means of cap screws 17 and a mount plate 53, O-ring 54 and stationary plate 55. The face plate 16 is bolted by means of bolts 27 to the wheel housing 18 of the abrasive propulsion device 38, as illustrated in FIG. 8. The cage 2 (illustrated in FIG. 9) extends through the center of the annular mobil cage plate 15 and the cage rim 3 of the cage 2 is fixedly attached to the cage plate 15. An adjusting shim 52 and mount plate 53 are inserted between the cage 2 and the face plate 16 to facilitated rotary adjustment of the cage 2 with respect to the mobile cage plate 15, as hereinafter described. The motor shaft (not illustrated) of the wheel motor 39 extends through a motor shaft opening (not illustrated) provided in the cage 2 (FIG. 2) and is attached to a motor shaft spline (not illustrated) provided on the impeller 8, which is suspended for rotation inside the cage 2, as heretofore described. The cage clamp 12 has a pair of cage clamp arms 12*a* extending from a cylindrical cage clamp body 12*b* and is bolted or otherwise fixedly attached to the cage plate 15. Furthermore, a cage clamp gasket 13 is provided in the cage clamp body 12*b*, as illustrated in FIG. 9, and receives the bevelled end 11 of the impeller 8. The feed conduit 37 (illustrated in FIG. 10) extends from a hopper (not illustrated) to the feed spout 30, which extends into the cage clamp body 12*b* of the cage clamp 12, terminating at the impeller 8. A cage pin 14 is bolted by means of cap screws 17 to the cage plate 15, as further illustrated in FIG. 8. A mobile actuator mount 21*b* extends from the cage pin 14, as illustrated in FIG. 9 and a stationary actuator mount 21*a* extends from the face plate 16, as illustrated in FIG. 8A. An actuator 21, having one end mounted on the stationary actuator mount 21*a*, includes an actuator arm 22, which is extendible from the opposite end of the actuator 21 and attached to the mobile actuator mount 21*b*. Remote-control operation of the actuator 21 from the cab (not illustrated) of the apparatus, made possible by suitable wiring and controls known to those skilled in the art, extends or retracts the actuator arm 22 and rotates the mobile plate 15, abrasive cage 2 and cage clamp 12 through a selected angle with respect to the stationary face plate 16, varying the position of the cage window 4 in the rotary wheel 26 and thus, the location of the abrasive "hot spot" on the surface 47, as hereinafter further described. As further illustrated in FIGS. 8 and 8A, one end of an indicator 24 may be mounted on the cage plate 15 by means of an indicator mount 24*a* and the opposite end of the indicator 24 indicates the degree of rotation of the cage plate 15 and abrasive cage 2 with respect to the face plate 16, by reference to an indicator panel 24*b*, which is mounted on the face plate 16. As illustrated in FIGS. 4–7, the wheel 26 is rotatably mounted with respect to the cage 2 by the motor shaft of the wheel motor 39. The wheel 26 is typically characterized by a pair of spaced wheel plates 26*a*, including a selected number of spacers 29, spanning the wheel plates 26*a* in circumferentially-spaced relationship. As further illustrated in FIGS. 5–7, a spacer bolt 25 is extended through each wheel plate 26*a* and threaded into each spacer 29. Multiple, generally rectangular wheel blades 28 are fixedly mounted between the wheel plates 26*a*, in radially-extending, circumferentially-spaced relationship.

Figure 11:
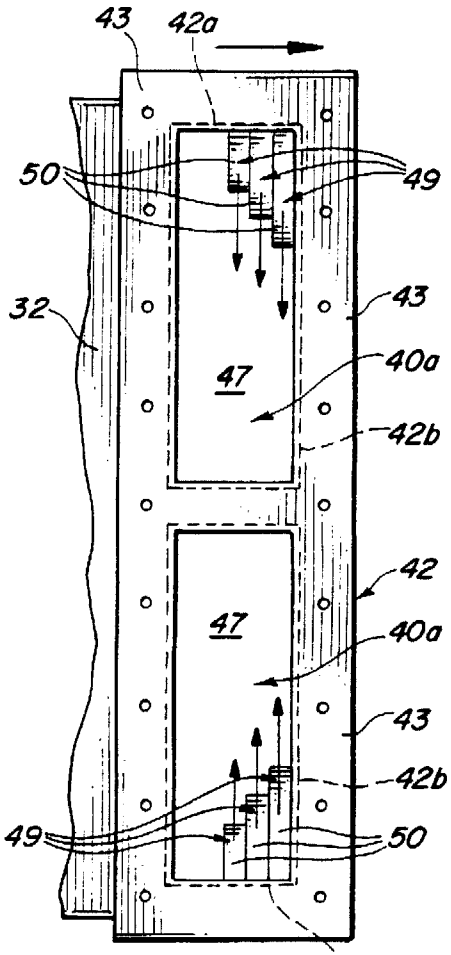
FIG. 11 is a sectional view, taken along section lines 11—11 in FIG. 10, of the discharge and deflector elements of the mobile surface abrading apparatus wheel housing of this invention.

Referring now to FIGS. 10, 11 and 12 in another preferred embodiment of the invention three deflectors 49, having dissimilarly angled strike surfaces 50, are mounted on or shaped in the discharge plenum 42 for receiving the abrasive blast from the impeller 8 of the wheel 26 and deflecting the abrasive from the respective strike surfaces 50 to the surface 47. This action "feathers" the deflected shot and causes a smooth, continuous treated surface when multiple passes are overlapped.

In operation, referring again to FIGS. 5–7 and 10 of the drawings, energizing of the wheel motor 39 causes rotation of the wheel 26 and impeller 8. A stream of the abrasive particulate is selectively and continually dispensed from a hopper through the feed conduit 37 and into the impeller 8, where the abrasive particulate falls through the rotating impeller slots 9 and the selectively-positioned cage window 4, respectively, and the wheel blades 28 propel the abrasive through the abrasive discharge opening 40*a* of the abrasive discharge 40 and the discharge plenum 42. Some of the abrasive then directly strikes the surface 47 in angular relationship, while other abrasive strikes the deflectors 49, as hereinafter described, thereby cleaning or etching an abrasive pattern in the surface 47 as the apparatus is advanced slowly thereon, as indicated by the arrows in FIGS. 10 and 11. As the abrasive is deflected from the surface 47, a stream of air formed by an air sweeper assembly (not illustrated) typically provided on the apparatus, is typically utilized in combination with the rebound energy of the abrasive, to carry the abrasive upwardly through the rebound leg 32, collection leg 34 and through associated abrasive recovery equipment, after which the abrasive is distributed back into the hopper and again discharged through the feed conduit 37 and into the impeller 8 of the abrasive propulsion device 38, to repeat the abrading process. The position of the cage window 4 in the wheel 26 determines an area along the width of the abrasive spread, or swath, where the most concentrated flow of abrasive, or "hot spot", strikes the surface 47, as hereinafter described. The wheel motor 39 is operated to rotate the wheel 26 and impeller 8 by energizing a switch (not illustrated), typically provided in the cab of the apparatus to discharge the stream of abrasive through the rotating impeller slots 9 and the cage window 4, respectively, onto the surface 47.

Figure 5:
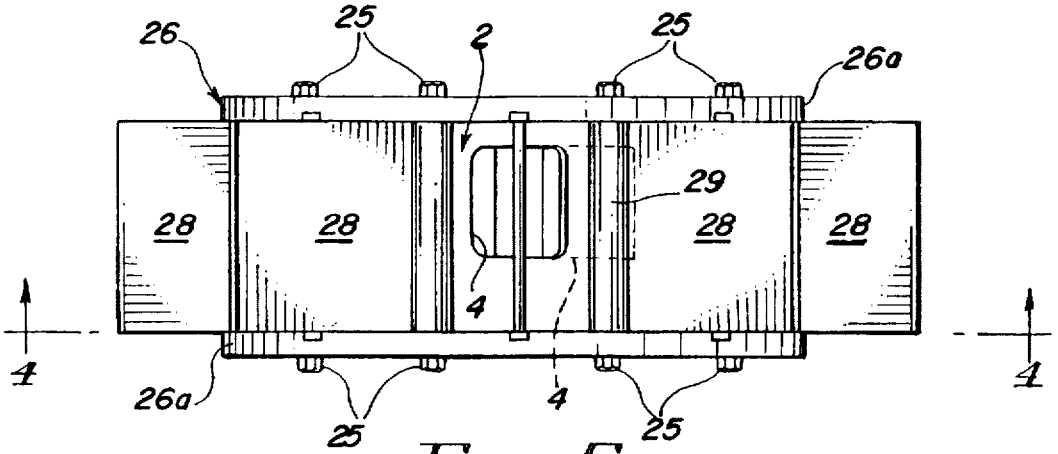
FIG. 5 is a bottom view of the assembled rotary wheel and cage of the adjustable cage assembly, more particularly illustrating in phantom a selected remotely-adjusted change in position of the cage and cage window.

The location of the abrasive "hot spot" on the surface 47 can be varied gradually by operation of the actuator 21 from the cab of the apparatus without having to halt operation of the wheel motor 39 and advancement of the apparatus on the surface 47. Operation of the actuator 21 rotates the cage plate 15 and cage 2 in the wheel housing 18, thus varying the position of the cage window 4 in the wheel 26, as illustrated in FIGS. 5–7, and varying the location of the abrasive "hot spot" on the surface 47 along the width of the abrasive blast swath. As illustrated in FIG. 5, the position of the cage window 4 may be adjusted such that the most concentrated flow of abrasive is in the center of the blast swath, or may be adjusted laterally a selected distance in either direction, as illustrated in FIGS. 6 and 7 and in phantom in FIG. 5, such that the most concentrated flow of abrasive in the abrasive swath is directed in either direction with respect to the center of the swath. Gradual, back-and-forth adjustment of the cage 2 and cage window 4 as the apparatus is slowly advanced on the surface 47, results in a textured pattern which is substantially uniform in abrasion along both the length and width of the pattern.

Referring again to FIGS. 10, 11 and 12 of the drawings, the multiple, typically three, triangular-shaped deflectors 49, having sloped strike surfaces 50 of varying angle, are adjacently welded, bolted or formed between the front wall 42*b* at each end of the discharge plenum 42. The side walls 42*a* and front walls 42*b* preferably engage the flange 43 such that the discharge openings 35 in the flange 43 are recessed inwardly with respect to the side wall 42*a* and front walls 42*b*. Accordingly, the side walls 42*a* and front walls 42*b* terminate at the flanges 41 and 43 of each discharge plenum 42 and abrasive discharge 40 of the wheel housing 18. The deflectors 49 having the shallowest slope are typically located adjacent to the front walls 42*b*, respectively, of the discharge extension 42, as illustrated in FIG. 12, with the deflectors 49 having the steepest slope, spaced from the front walls 42*b* and the deflectors 49 having an intermediate slope located between the shallowest and steepest deflectors 49. As the apparatus is advanced on the surface 47 in the direction of the arrows in FIG. 11 and the abrasive is propelled from the abrasive propulsion device 38 into the discharge plenum 42, the abrasive in the lateral portions of the abrasive swath strikes the respective strike surfaces 50 of the deflectors 49 and is deflected from each deflector 49 at the discrete corresponding respective angle in the direction of the arrows in FIGS. 11 to the surface 47, which angle is more shallow than the angle at which the abrasive in the remaining portions of the blast swath strikes the surface 47. The deflected abrasive thus produces light, feathered abrasion in the edges of the textured pattern in the surface 47. Because the edges of the textured pattern are more lightly-abraded than the remaining portions of the pattern, an adjacent pass or traversal on the surface 47 with the apparatus results in equal abrasion in the overlap area of the resulting textured patterns as in the remaining portions of each pattern, thus producing a surface texture pattern substantially devoid of streaks, grooves or other excessively deep overlap marks. Consequently, the resulting textured pattern has a visually-pleasing, professional appearance and facilitates substantially uniform texture and drainage over all areas of the surface 47.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. An adjustable cage assembly for varying the contact area of abrasive discharged on a surface to be treated by a rotating wheel mounted in the wheel housing of a mobile surface abrading apparatus, said adjustable cage assembly comprising a cage plate adjustable mounted on the wheel housing; a cage fixedly secured to said cage plate, said cage extending axially into said wheel; a cage window provided in said cage; a remotely-operated actuator mounted on the wheel housing, said actuator connected to said cage plate for selectively adjusting said cage with respect to said wheel; an impeller extending into said cage and mounted on said wheel for rotation with said wheel; and at least one impeller slot provided in said impeller for sequentially rotatably aligning with said cage window responsive to rotation of said impeller inside said cage, whereby the abrasive is discharged through said at least one impeller slot and said cage window onto the wheel and the abrasive strikes selected locations on the surface, responsive to operation of said actuator.

2. The adjustable cage assembly of claim 1 wherein said at least one impeller slot comprises a plurality of impeller slots provided in said impeller.

3. The adjustable cage assembly of claim 1 wherein said at least one impeller slot comprises a plurality of impeller slots provided in said impeller.

4. The adjustable cage assembly of claim 1 comprising deflector means provided in the wheel housing for deflecting at least a portion of the abrasive blast swath to the surface.

5. The adjustable cage assembly of claim 4 wherein said at least one impeller slot comprises a plurality of impeller slots provided in said impeller.

6. An adjustable cage assembly for varying the surface impact area of at least the most concentrated flow of abrasive in an abrasive blast swath directed onto a surface to be treated by a mobile surface abrading apparatus having a discharge housing disposed over the surface, an abrasive discharge opening provided in the bottom of the discharge housing, a wheel housing provided above the discharge housing, a wheel journalled for rotation in the wheel housing above the abrasive discharge opening and a wheel drive motor carried by the wheel housing and engaging the wheel for rotation of the wheel, said adjustable cage assembly comprising a generally cylindrical cage having a cage window, said cage extending axially in the wheel; a cage-plate adjustably attached to the wheel housing; a remotely-operated actuator having one end mounted on the wheel housing and the opposite end of said actuator connected to said cageplate, for remotely rotatably adjusting said cage a selected distance with respect to said wheel housing; and a generally cylindrical impeller having at least one impeller slot, said impeller extending in said cage and disposed for rotation with the wheel, whereby the abrasive is fed axially to said cage and discharged through said at least one impeller slot and said cage window, respectively, and a portion of the abrasive blast swath strikes the surface at selected areas responsive to adjustment of said actuator.

7. The adjustable cage assembly of claim 6 comprising at least one deflector having an angular strike surface provided in the discharge housing at the discharge opening for deflecting at least a portion of the abrasive blast swath over a selected area of the surface.

8. The adjustable cage assembly of claim 7 wherein said at least one deflector comprises a plurality of deflectors, each of said deflectors having strike surfaces disposed at different angles with respect to each other.

9. The adjustable cage assembly of claim 8 wherein said at least one impeller slot comprises a plurality of impeller slots provided in said impeller.

10. In a mobile surf ace abrading apparatus adapted for traversing a horizontal pavement surface, said apparatus having a discharge housing, a wheel housing mounted on the discharge housing, an abrasive discharge opening provided in the bottom of said discharge housing, a wheel journalled for rotation in said wheel housing, multiple wheel blades extending radially in said wheel in spaced relationship and a wheel motor mounted on said housing and engaging said wheel for rotation of said wheel with respect to said wheel housing, the improvement comprising a cage plate rotatably mounted in said wheel housing and a generally cylindrical cage having a cage window, said cage extending axially in said wheel and attached to said cage plate; a remotely-operated actuator having one end mounted on said wheel housing and the opposite end of said actuator connected to said cage plate for remotely adjustably rotating said cage a selected increment with respect to said housing; an impeller having a plurality of impeller slots, said impeller extending in said cage and disposed for rotation with the wheel wherein said impeller slots sequentially align with said cage window; and at least two deflectors provided in the discharge housing below said wheel housing, said deflectors each having a strike surface disposed at different angles with respect to each other, whereby a portion of the abrasive blast swath strikes said strike surfaces of said deflectors and is deflected by said deflectors to strike the surface at a selected area and angle responsive to operation of said actuator.

11. The mobile surface abrading apparatus of claim 10 wherein said at least two deflectors comprises three deflectors provided on each end of said discharge housing.

* * * * *